US011725370B1

(12) United States Patent
McFarland

(10) Patent No.: US 11,725,370 B1
(45) Date of Patent: Aug. 15, 2023

(54) DEVICE AND METHOD FOR AMPLIFIED WATER DISBURSEMENT

(71) Applicant: Farland Designs, LLC, Daytona Beach, FL (US)

(72) Inventor: Jackson McFarland, Daytona Beach, FL (US)

( * ) Notice: Subject to any disclaimer, the term of this patent is extended or adjusted under 35 U.S.C. 154(b) by 232 days.

(21) Appl. No.: 17/304,607

(22) Filed: Jun. 23, 2021

(51) Int. Cl.
*E03C 1/08* (2006.01)
*E03C 1/02* (2006.01)
*B05B 1/26* (2006.01)

(52) U.S. Cl.
CPC ..... *E03C 1/08* (2013.01); *B05B 1/262* (2013.01); *E03C 2001/026* (2013.01)

(58) Field of Classification Search
CPC .. B05B 1/06; B05B 1/14; B05B 1/262; E03C 1/22; E03C 1/0408; E03C 1/181; E03C 1/08; E03C 2001/026
USPC ..... 239/461
See application file for complete search history.

(56) References Cited

U.S. PATENT DOCUMENTS 3,603,345 A * 9/1971 Verwys ..... E03C 1/181 137/582
4,213,567 A * 7/1980 McIntire ..... B05B 1/262 169/37
5,452,484 A * 9/1995 Hill ..... E03C 1/181 4/658
8,539,618 B2 9/2013 Gibson
9,267,271 B2 2/2016 Lu
9,572,323 B2 2/2017 Lipscomb
2007/0011806 A1 1/2007 Knowlton
2016/0289933 A1 10/2016 Williams

OTHER PUBLICATIONS https://en.aliradar.com/item/4000521456302-bathroom-cartoon-faucet-extender-for-kids-washing-hand-saving-water-kitchen-guide-sink-faucet-extension-bathroom-accessories.
https://en.aliradar.com/item/32866376567-kitchen-rotating-crane-extender-water-tap-faucet-extender-bathroom-water-saving-children-kid-hand-wash-crane-faucet-extenders.

* cited by examiner

*Primary Examiner* — Christopher R Dandridge
(74) *Attorney, Agent, or Firm* — Lori Sandman, Esq

(57) ABSTRACT

The device and method disclosed comprises a portable housing continuous with a base that affixes to a drain stopper or directly to a sink or water basin to receive and direct water from a faucet or other similar dispenser, enlarging the surface area upon which the water flows. Greater water disbursement caused by the different flow configuration created by this device allows the sink or basin to stay cleaner by reducing dirt, debris, germs and grime buildup that would otherwise occur with use.

12 Claims, 4 Drawing Sheets

DEVICE AND METHOD FOR AMPLIFIED WATER DISBURSEMENT

CROSS-REFERENCE TO RELATED APPLICATIONS

Not applicable.

STATEMENT REGARDING FEDERALLY SPONSORED RESEARCH/DEVELOPMENT

Not applicable.

REFERENCE TO SEQUENCE LISTING, A TABLE, OR COMPUTER PROGRAM LISTING COMPACT DISC APPENDIX

Not applicable.

BACKGROUND OF THE INVENTION

This disclosure pertains to the field of liquid catch and diversion devices and methodology. More specifically, it relates to a device and method for directing water flowing into wash-stands, water basins, sinks and drains, and appurtenances for disbursing water therefor. The device and method disclosed comprise a portable housing with a base that affixes to a drain stopper or directly to a water basin to receive and direct water from a faucet or other similar dispenser, enlarging the surface area upon which the water flows. Amplified water disbursement and redirection caused by the different flow configuration created by this device allows the sink or basin to stay cleaner by reducing germ and grime buildup that would otherwise occur with use.

Sinks and water basins are used to clean people and their things. As such, they accumulate dirt and germs, potentially building up for some time before they are cleaned. Faucets typically dispense water in a stream into a sink or basin, and water flows from this stream onto a single area in the sink or basin and then drains, or flows into the drain directly. Hand washing, dish cleaning, and other sink use can leave residue, which can be unsightly and difficult to clean at best, and a serious health hazard in a worse-case scenario. Splashing from the sink or basin can spread dirt and debris and cause health concerns. Toothpaste and mouth waste from brushing teeth leaves buildup where bacteria and other microbes can grow and proliferate. When waste, debris and germs are not rinsed as they fall into the sink or basin, they dry onto the surface and become even more difficult to clean.

Sink and basin cleaning and debris removal solutions presently known include faucet housings and extension components of various designs, powered spray injectors, chemical solutions and drain covers to stop water flow. However, these solutions fall short. Faucet housings and extensions are generally mounted on the faucet and interfere with the water flow as it comes out of the tap. They can get dirty and become contaminated, and also are mostly permanent or attached onto the faucet. Powered spray injectors require power, which is not always compatible with liquid environments, and are costly and permanently mounted. Many also require specialized basins and a spectrum of parts, which can get clogged or broken in wet, dirty places. Chemical cleaners need to be dispensed somehow, and are expensive, especially when used continuously or at every faucet use. What is needed is an inexpensive, portable and easily removeable device and method for redirecting water to cleaning a sink or basin as it is used, without chemical additives or power requirements.

The present invention provides a cleaner, healthier sink, washtub, washstand or basin (hereinafter, "receptacle"). The device is capable of immediately rinsing the receptacle surface area continuously during water flow. It does not impede the faucet as it does not contact it; instead, water flowing from the tap falls onto the device of the invention. In a preferred embodiment, the device mounts directly upon the sink drain stopper, however not all faucets flow directly onto that point in the receptacle. A second embodiment is capable of mounting directly to the receptacle surface where the stream of water flows onto and hits the receptacle. In a different embodiment, the device is capable of mounting directly into a drain hole and supported therein by an extension of the body of the device. As the water hits the device, whether it is mounted in, on, or near the drain, it is redirected and the force of the flow is amplified by increased pressure and directed around the bowl or basin of the receptacle, rinsing it immediately.

BRIEF SUMMARY

The present invention includes a device and method of using the device. The device comprises a removeably attachable body capable of attachment to a receptacle at or near its drain. In one embodiment, it is attached onto a standard, commercially available receptacle drain stopper. In this embodiment, the device attaches with a flexible lip and mild suction to the drain stopper. Because of this attachment to the drain stopper and the flexible lip surrounding it, the device has the advantage of further sealing the drain, making loose drain stoppers tight against water loss. Alternatively, the device can be attached by hand pressure directly to the receptacle; the device stays in place by suction, but is easily removed. Or, an embodiment of the device can be placed directly into the drain and supported by a shoulder in the device body. The device catches, amplifies the pressure and disperses the water coming from the faucet (tap). Water is redirected from the faucet flow pattern when it hits the device mounted to the receptacle and is dispersed under additional pressure and directed out around the receptacle to rinse and clean it in real time, keeping it clean and reducing the opportunity for dirt, grime, germs and debris to stick and pollute the receptacle environment.

Improvements to the present art include portability and removeability. Rather than having a specially molded basin or a basin that accommodates multiple water sources, this device requires no special casting or plumbing and can be easily removed. Also, this small device is more cost effective than other methods of increasing water disbursement, as it is made of inexpensive material and easily manufactured, without moving or breakable parts. It uses the flow of water from the faucet, as it is being used, to clean. Additionally, this device has the advantage of being more hygienic for certain applications, as water disbursement is designed to eliminate buildup in the receptacle rather than restrict flow to reduce potential splashing or aerosolization. The device and method work with existing receptacles of all shapes and sizes to catch, amplify, and direct water around a receptacle and eventually to a drain.

It is an object of the invention disclosed to provide a device for real time, continuous receptacle rinsing while using the water flowing from a faucet into a receptacle.

It is a separate object of the invention to provide a cost-effective means for redirecting water around a receptacle bowl or basin to clean it.

It is a different object of the invention to provide a hygienic method to use the power of water flow from a faucet to continuously clean a receptacle while it is in use.

REFERENCE CHARACTERS USED IN THE DRAWINGS

1. device body
5. directing surface
10. amplifying aperture
15. grip lip
20. suction surface
25. area for indicia

BRIEF DESCRIPTION OF THE DRAWINGS

The following figures form part of the present specification and are included to further demonstrate certain aspects of the present claimed subject matter, and should not be used to limit or define the present claimed subject matter. The present claimed subject matter may be better understood by reference to one or more of these drawings in combination with the description of embodiments presented herein.

DETAILED DESCRIPTION OF THE INVENTION

While various embodiments are described herein, it should be appreciated that the present invention encompasses many inventive concepts that may be embodied in a wide variety of contexts. Illustrative embodiments of the invention are described below. Not all features of an actual implementation for all embodiments are necessarily described in this specification. In the development of any such actual embodiment, implementation—specific decisions may be made to achieve the design specific goals, which may vary from one implementation to another. It will be appreciated that such a development effort would be a routine undertaking for persons of ordinary skill in the art having the benefit of this disclosure.

Figure 1:
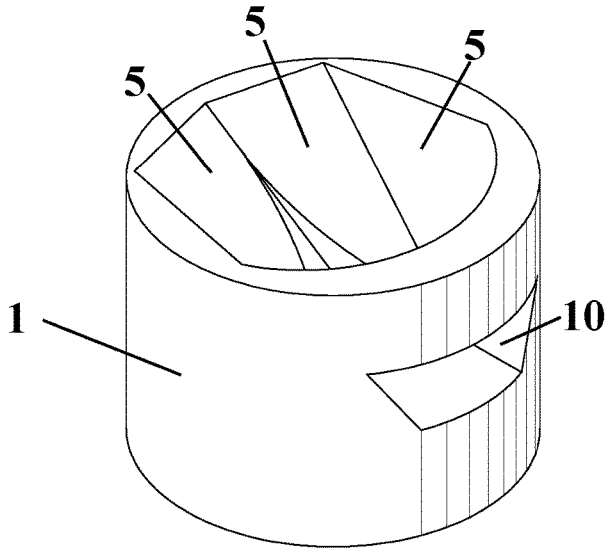
FIG. 1 is a perspective view of the device of the invention.

FIG. 1 is a perspective view of the device of the invention. In this figure, the device body 1 is shown with a single amplifying aperture 10. The device body 1 is pressed onto a drain stopper or directly upon the surface of a receptacle, and is held there by mild suction, created between the receptacle and the bottom surface of the device. In one embodiment, the device is capable of being placed on a drain stopper and pressed onto it, whereby the grip lip 15 is positioned around the top of a drain stopper and pushed by hand to engage suction. The suction is created as a function of a curved or concave bottom, the suction surface 20 of the device, in combination with the material used in manufacture. In a preferred embodiment, a range of materials could be used in manufacture, including elastomers of various compositions, silicone, natural or synthetic rubber, or similar, with extensible, compliant and reflexive material characteristics, capable of receiving hand pressure and returning to an original conformation.

Figure 2:
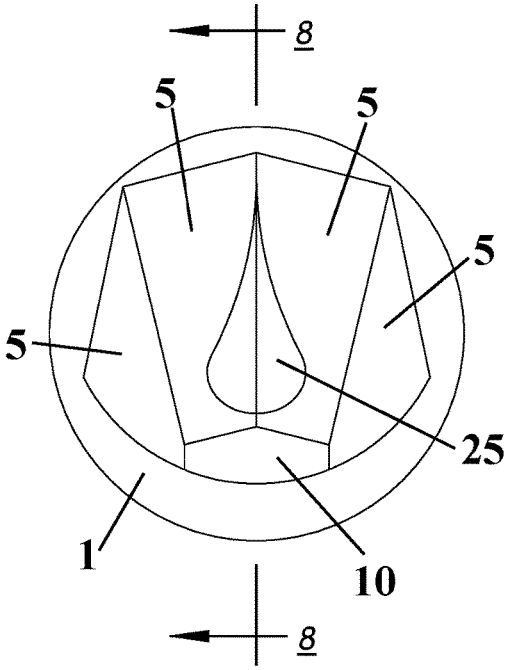
FIG. 2 is a top plan view thereof, with the section shown in FIG. 8 indicated by the lines 8-8.
Figure 8:
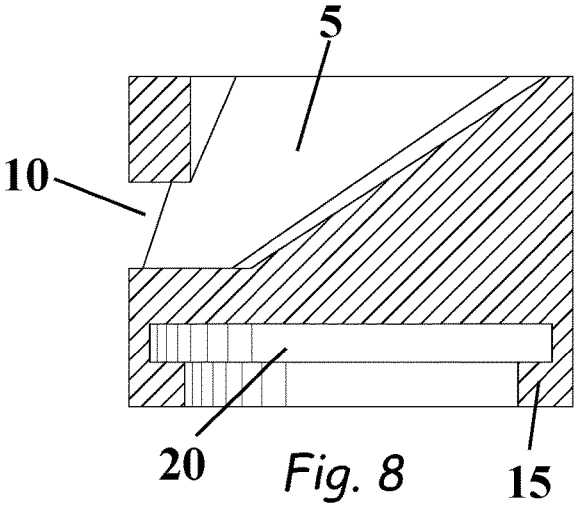
FIG. 8 is a sectional view of an embodiment as shown in FIG. 2 with the section shown as indicated by the lines 8-8.

In FIG. 2, a top plan view of the device with a single amplifying aperture 10 is shown, with the section shown in FIG. 8 indicated by the lines 8-8. In this view, the device body 1 is drawn and is continuous with one or more directing surfaces 5. Water flowing from the tap contacts the directing surfaces 5 and is thereby directed to one or more amplifying apertures 10. The water pressure is amplified because the kinetic energy from the water falling from the faucet as well as the increased force as it moves through the size-restricted amplifying aperture 10. This FIG. 2 also shows an area that may be appropriate for placement of a logo or other indicia, the area for indicia 25. In this drawing a "droplet" shape is shown on the area for indicia 25, but one skilled in the art would recognize that any logo, branding, artwork or other indicia could be placed on the device, either on the area for indicia 25 or other locations on the device body 1.

Figure 3:
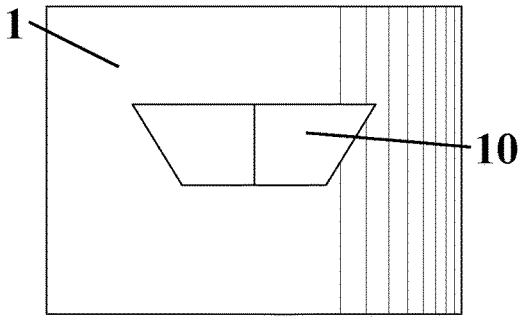
FIG. 3 is a front elevational view thereof.

FIG. 3 is a front elevational view of the device of the invention disclosed herein. One or more amplifying apertures 10 pass through the device body 1. In a preferred embodiment, the device body 1 is circular, but a variety of shapes could be used to direct water flow from the faucet out to the receptacle, and still be contemplated by this disclosure. Similarly, FIG. 3 shows the amplifying aperture 10 as quadrilateral with four edges (sides) and four vertices (corners); a longer top edge length angles down to a shorter aperture bottom edge; it should be understood that this is one possible embodiment and that other aperture shapes could be employed to direct flow as desired.

Figure 4:
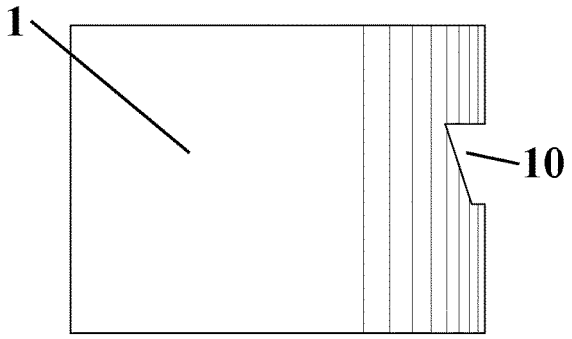
FIG. 4 is a left side elevational view thereof.
Figure 5:
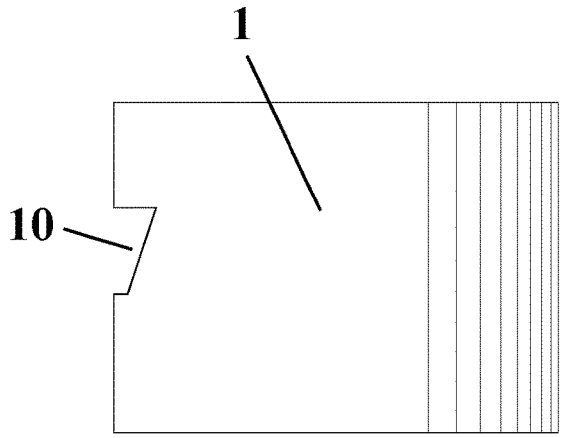
FIG. 5 is a right side elevational view thereof.
Figure 6:
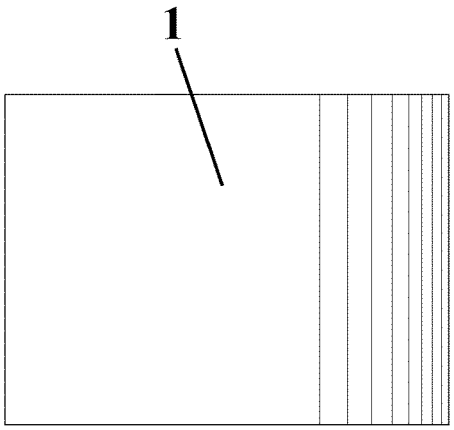
FIG. 6 is a back side elevational view thereof.

In FIG. 4, a side elevational view shows the circular device embodiment of FIG. 3, with a single quadrilateral amplifying aperture 10. A longer top edge is angled inward at the vertices, and the side edges meet a shorter, bottom edge. In this configuration, the amplifying aperture 10 directs and amplifies the stream of water flowing through it, and spreads it out over the surface of the receptacle. FIG. 5 is a mirror image of FIG. 4, illustrating a circular embodiment of a device body 1 with a single amplifying aperture 10. In alternate embodiments of the invention contemplated by this disclosure, a plurality of amplifying apertures 10 can be positioned at various locations on, and passing through the device body 1 in order to direct water to desired locations within a receptacle. FIG. 6 illustrates this embodiment from a back elevational view.

Figure 7:
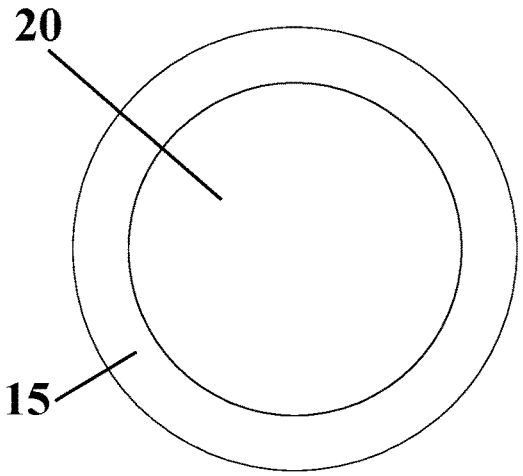
FIG. 7 is a bottom plan view of an embodiment with a lip attachment.

In FIG. 7, one embodiment of the bottom of the device of the invention is shown. A grip lip 15 is formed continuously with the device body 1 and seamlessly joins the suction surface 20. The suction surface 20 may be flat, or may be concave or curve inward toward the center, in order to increase suction. The grip lip 15 is flexible and reflexive like the rest of the device body; it is capable of flex and recoil either to its original configuration, unattached to the receptacle, or with the lip surrounding a drain stopper top and removeably attached to it with gentle suction. Applying pressure by hand sets and attaches the device body 1 to a drain stopper, where it is supported by the grip lip 15 in order to catch water flowing from the faucet.

FIG. 8 shows a sectional view of the device body 1 of the embodiment shown in FIG. 2, as marked thereon. In this view, the amplifying aperture 10 is shown continuous with one or more directing surface 5 that directs the flow of water through the amplifying aperture 10 and out into the receptacle. Also, the FIG. 8 section shows the suction surface 20 extending outward to the grip lip 15. When the device body 1 is pressed downward from the top, it flexes outward, allowing the grip lip 15 to surround the outside of a drain stopper. When pressure is removed, the device stays in place upon the drain stopper because the grip lip 15 now surrounds and supports it. The device body 1 is further positioned and supported with mild suction from the suction surface 20 which is also engaged upon pressing the device against the drain stopper.

Figure 9:
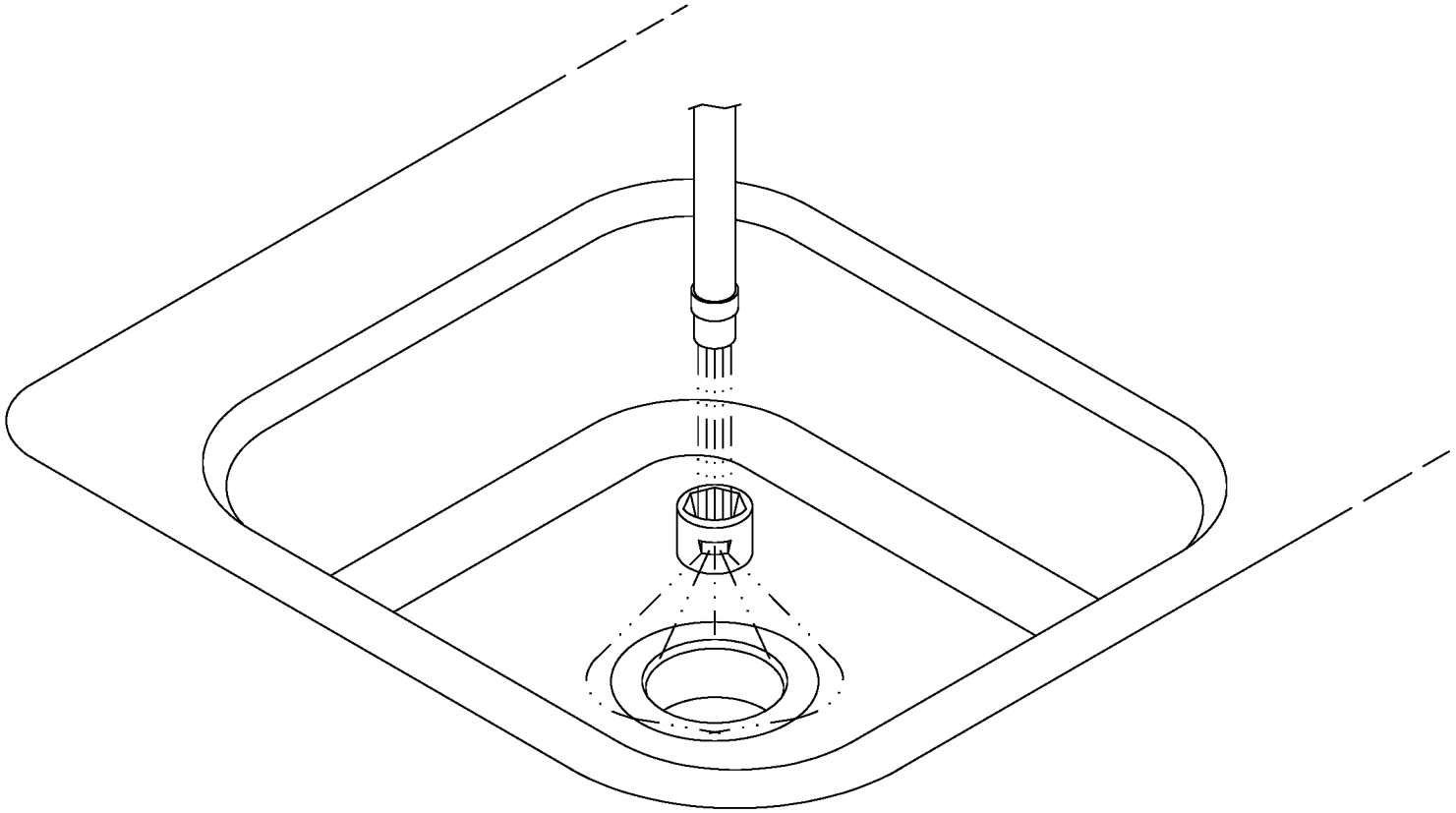
FIG. 9 illustrates the device mounted within a sink and receiving water from the faucet, amplifying and directing the water flow in real time.

FIG. 9 illustrates the device mounted within a sink and receiving water from a faucet, amplifying and directing the water flow in real time. As water flows from the faucet or tap, it enters the device body 1 which is positioned below the flow. If there is a drain stopper, an embodiment with a grip lip 15 is placed so that water flows into the device body 1. The water contacts the directing surface 5, which directs the water through one or more amplifying apertures 10. Water is directed by the shape of the amplifying aperture 10 and the volume of water flowing through it.

Figure 10:
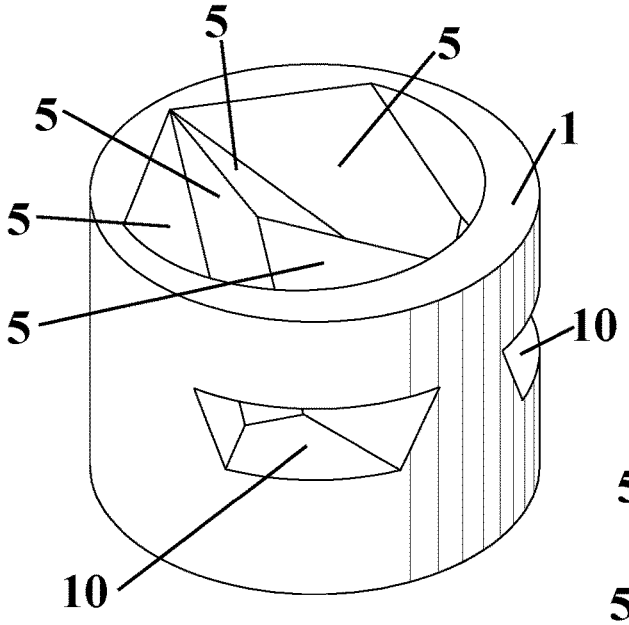
FIG. 10 is a perspective view of an embodiment of the device with a plurality of water directing apertures.

FIG. 10 is a perspective view of an embodiment of the device with a plurality of directing surfaces 5 and amplifying apertures 10. In this embodiment two amplifying apertures 10 are depicted; one skilled in the art would appreciate that any number of apertures in and through the device body 1 could be used and considered within this disclosure. Similarly, a plurality of angled directing surfaces 5 are shown directing the water flow into and through the amplifying apertures 10.

Figure 11:
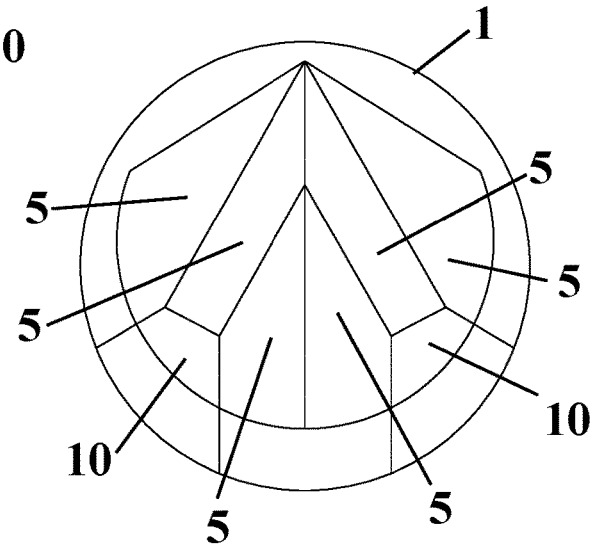
FIG. 11 is a top plan view of the embodiment shown in FIG. 10.

In FIG. 11, the device of the embodiment illustrated in FIG. 10 is presented from a top plan view. In this figure, two amplifying apertures 10 direct water entering the device, the flow contacting and being directed through the amplifying apertures 10 from a plurality of angled directing surfaces 5, which are formed continuously with the device body 1.

Figure 12:
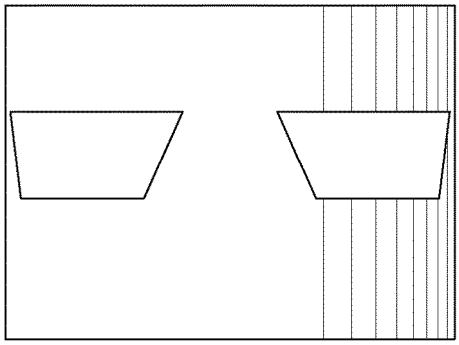
FIG. 12 is an elevational view of the embodiment shown in FIGS. 10 and 11.

FIG. 12 is an elevational view of the embodiment shown in FIGS. 10 and 11. In this figure, two amplifying apertures 10 are present in the device body 1. Depending on the shape, size and position of the amplifying aperture 10, water can be directed in a variety of spray patterns and shapes. This disclosure contemplates such changes to the shape, size and position of the amplifying apertures 10 to create different spray dimensions and accommodate differently shaped receptacles.

Figure 13:
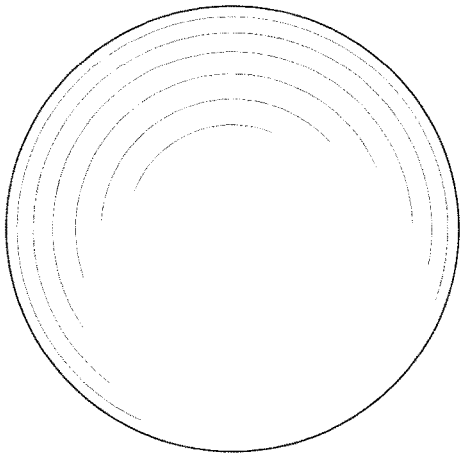
FIG. 13 is a bottom plan view of an embodiment without a grip lip element.

FIG. 13 shows the bottom of a device body 1 in an embodiment without a grip lip 15. In this embodiment, the device can be attached anywhere in the receptacle to be positioned under the flow from the faucet. This is convenient where there is no drain stopper, or the drain stopper is not positioned underneath the flow from the faucet. Suction is actuated by pressing the device into and onto the surface of the receptacle; pressure placed by hand on the top of the device body 1 causes the device to flex, the concave suction surface 20 to flatten and create suction for releasable attachment of the device to the receptacle. The device can be removed from the surface of the receptacle or the drain stopper by gently pulling it to release suction.

The invention herein also contemplates a method of amplifying and directing water using the device disclosed. The method involves the following steps; these steps are described generally and may be operated in a different order and still be within the disclosure presented. First, attach the device for amplified water disbursement to a receptacle at a location under the flow of water from a faucet, either on a drain stopper using an embodiment with a grip lip 15 or on the surface of the receptacle using an embodiment without a lip grip 15, by applying pressure to the top of the device body 1 until it flexes slightly and is removeably positioned thereon by suction. Once the device is in place, turn on the flow of water to direct the flow onto the top of the device body 1 such that it contacts the directing surface 5 and flows through one or more amplifying apertures 10 and is directed under pressure to the receptacle, where the amplified and directed water flow rinses and cleans the receptacle while the water is running. The device can be removed and positioned easily under the flow of water if the faucet or flow changes position; reposition the device and change water flow as desired to change or extend the flow of water to other areas of the receptacle. Once use of the faucet has been completed, turn off the flow of water and allow the device to remain in place in or on the receptacle, or remove the device by gently pulling on the device body 1 to remove suction and thereby release the device from the surface of the drain stopper or surface of the receptacle.

I claim:

1. A water directing and amplifying device comprising:

a device body, wherein said device body further comprises:

(i). a top surface, serving as an inlet of the device body;

(ii). a bottom suction surface, wherein said suction surface includes either a lip or a concave surface that provides a suction engagement to a surface of a receptacle, and provides an opposing force to a fluid issued through the device body;

(iii). one or more directing surfaces circumscribed by the device body; and (iv). one or more amplifying apertures downstream of the one or more directing surface, extending through a side surface of the device body, and serving as an outlet of the device body;

wherein said one or more directing surfaces cooperate and provide a funneling surface that extends obliquely from the top surface to an introductory surface that is continuous with the one or more amplifying apertures within the device body, and wherein said—introductory surface is planar with the one or more amplifying apertures, and extends from the directing surface, terminating at the one or more amplifying apertures; the directing surfaces providing a downstream passage of fluid from the top surface to the introductory surface, to the one or more amplifying apertures;

said amplifying apertures receiving the fluid, and directing the fluid out of the device body, under amplified pressure, to the surface of the receptacle.

2. The device of claim 1 wherein the device body further comprises extensible, compliant and reflexive material characteristics, capable of receiving hand pressure and returning to an original conformation.

3. The device of claim 2 wherein the device body is manufactured from elastomers, silicone, or natural or synthetic rubber.

4. The device of claim 1 wherein the suction surface is reflexive, and can be actuated by hand pressure to generate the suction to attach the device to the surface.

5. The device of claim 1 wherein the number of amplifying apertures is one.

6. The device of claim 1 wherein the number of amplifying apertures is more than one.

7. The device of claim 1 wherein the one or more amplifying apertures are quadrilateral and further comprise four edges and four vertices that are configured with a longer top edge length, and side edges that angle down to a shorter bottom edge of the aperture.

8. The device of claim 1 further comprising the lip; said lip is flexible and reflexive, formed continuously with the device body and seamlessly joins the suction surface.

9. The device of claim 8 wherein the suction surface is convex.

10. The device of claim 8 wherein the suction surface is flat.

11. The device of claim 1 further comprising an area for indicia.

12. A method of amplifying and disbursing water from a faucet, the method comprising the following steps:

a. attach the device of claim 1 for amplified water disbursement to a receptacle at a location under the flow of water from a faucet, either on a drain stopper using an embodiment with a grip lip or on the surface of the receptacle using an embodiment without a lip grip, by applying pressure to the top of the device body until it flexes and is removably positioned thereon by suction;

b. turn on the flow of water to direct the flow onto the top of the device body such that it contacts the directing surface and flows through one or more amplifying apertures and is directed under pressure to the receptacle, where the amplified and directed water flow rinses and cleans the receptacle while the water is running;

c. reposition the device and change water flow as desired to change or extend the flow of water to other areas of the receptacle; and d. turn off the flow of water and allow the device to remain in place in or on the receptacle, or remove the device by gently pulling on the device body to remove suction and thereby release the device from the surface of the drain stopper or surface of the receptacle.

* * * * *